United States Patent [19]

Reedy et al.

[11] 3,988,784

[45] Nov. 2, 1976

[54] PROTECTIVE SINK COVER

[75] Inventors: Marvin E. Reedy, West Covina; Roy D. Shook, Mira Loma, both of Calif.

[73] Assignees: Gary Harding; Patricia Garfield, both of Fullerton, Calif. ; part interest to each

[22] Filed: Aug. 1, 1975

[21] Appl. No.: 601,028

[52] U.S. Cl. ..... 4/1; 4/187 A; 4/172.12

[51] Int. Cl.[2] ..... A47K 17/00; E03C 1/18

[58] Field of Search ..... 4/187 A, 187, 173, 174, 4/175, 177, 177 IW, 1, 172.12, 172.11, 167, 166, 169, 188, 189, 190, 295

[56] References Cited

UNITED STATES PATENTS

| | | | |
|---|---|---|---|
| 1,841,143 | 1/1932 | McCann | 4/173 |
| 2,194,343 | 3/1940 | Wexler | 4/187 R |
| 2,308,123 | 1/1943 | Stein | 4/187 R |
| 2,334,293 | 11/1943 | Stein | 4/189 |
| 2,447,788 | 8/1948 | Ball | 4/187 R |
| 2,746,062 | 5/1956 | Waltz | 4/187 R |
| 3,346,888 | 10/1967 | Paysinger | 4/253 |

*Primary Examiner*—Henry K. Artis
*Attorney, Agent, or Firm*—Raymond L. Madsen

[57] ABSTRACT

There is disclosed a protective cover having a base member adapted to engage and mate with the peripheral lip of a sink whereby the opening and the edges thereof are covered and protected, the base member having a plurality of projections extending therefrom into the sink opening and adapted to engage the inner-side surfaces of the sink to align the base member in the sink opening. An elongated rod is attached to the base member and extends into the sink opening, the rod having a resilient plug mounted thereon which is adapted to engage and seal the drain opening of the sink and to mechanically support the base member over the sink opening and in engagement with the peripheral lip of the sink.

5 Claims, 4 Drawing Figures

PROTECTIVE SINK COVER

The present invention relates to sink covers and closures and more particularly to a combined protective cover and drain seal for a floor sink.

In the field of plumbing installations, it has been the general practice to install floor sinks by connecting them to the associated plumbing and then to plug the drain opening and fill the interior of the sink with sand to protect the sink while the floor is constructed therearound. The sand serves to protect the sink from objects being dropped thereinto and to bear the weight of personnel and the equipment which may pass thereover. Although filling the sink with sand has served the purpose, it has not proved entirely satisfactory under all conditions of service for the reason that considerable difficulty has been experienced in removing the sand and avoiding chipping the edges of the sink during the construction of the floor therearound. Further difficulty has been experienced with adequately sealing the drain opening for the sink to enable the associated plumbing to be checked for leaks. Those concerned with the installation of floor sinks have long recognized the need for a protective cover and reliable drain seal. The present invention fulfills this need.

One of the most critical problems confronting plumbers has been the shipping and handling of floor sinks without chipping or breaking the peripheral edges thereof. This problem is overcome by the present invention.

The general purpose of this invention is to provide a protective cover and drain seal for a sink to protect the sink during shipping and installation and to seal the sink drain opening during installation and which cover embraces all the advantages of similarly employed protective devices and measures and none of the aforedescribed disadvantages. To attain this, the present invention contemplates a unique protective cover with alignment projections thereon in combination with a drain seal whereby damage to a sink during shipping and installation and leaking drain seals are avoided.

An object of the present invention is the provision of a protective cover for a sink to prevent the edges thereof being chipped or damaged during shipping and installation.

Another object is to provide a dependable and reliable seal for the drain opening of a sink during installation.

A further object of the invention is the provision of a protective cover to prevent damage to a sink during shipping and installation in combination with a dependable and reliable drain seal which supports the central portion of the cover when personnel and equipment are passed thereover.

Other objects and many of the attendant advantages of this invention will be readily appreciated as the same becomes better understood by reference to the following detailed description when considered in connection with the accompanying drawings in which like reference numerals designate like parts throughout the figures thereof and wherein.

Figure 1:
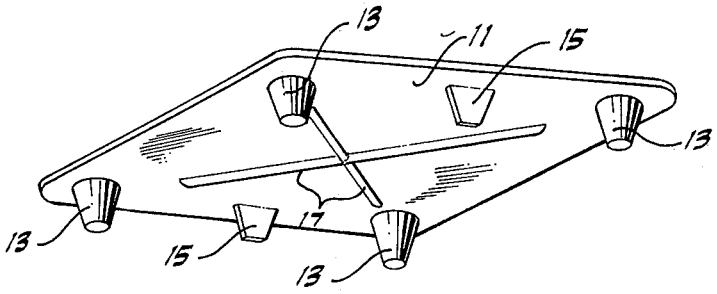
FIG. 1 shows a perspective view of a preferred embodiment of the invention.

Referring now to the drawings wherein like reference characters designate like or corresponding parts throughout the several views, there is shown in FIG. 1 (which illustrates a preferred embodiment of the basic cover) a flat rectangular base member 11 having four short tapered leg projections 13 located substantially in the four corners thereof, and two tab projections 15 oppositely disposed and centrally located substantially along two sides of base member 11. Base member 11 further has two intersecting diagonal ribs 17 thereacross.

Figure 2:
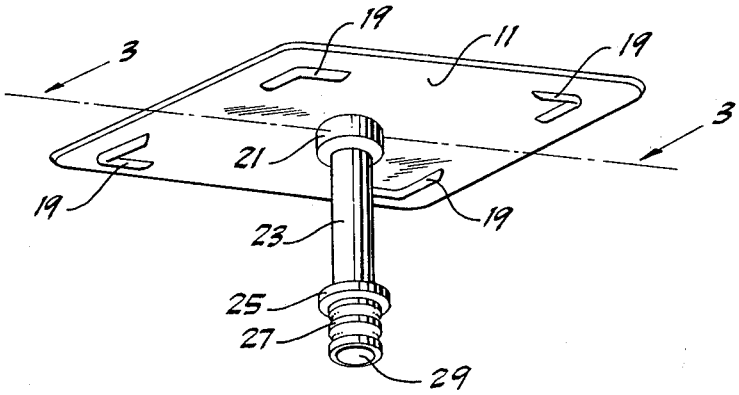
FIG. 2 illustrates a perspective view of another embodiment of the present invention with a drain seal.

Turning now to FIG. 2, there is illustrated an alternate embodiment of the present invention with a drain seal showing base member 11 with four curved projections 19 substantially located respectively in the four corners thereof and with a cylindrical recess 21 centrally located thereon to which is attached elongated rod 23 which in turn is attached to circular collar 25 upon which is mounted a circularly ribbed resilient plug 27 by bolt 29 passing through a central opening therethrough and into the end of rod 23.

Figure 3:
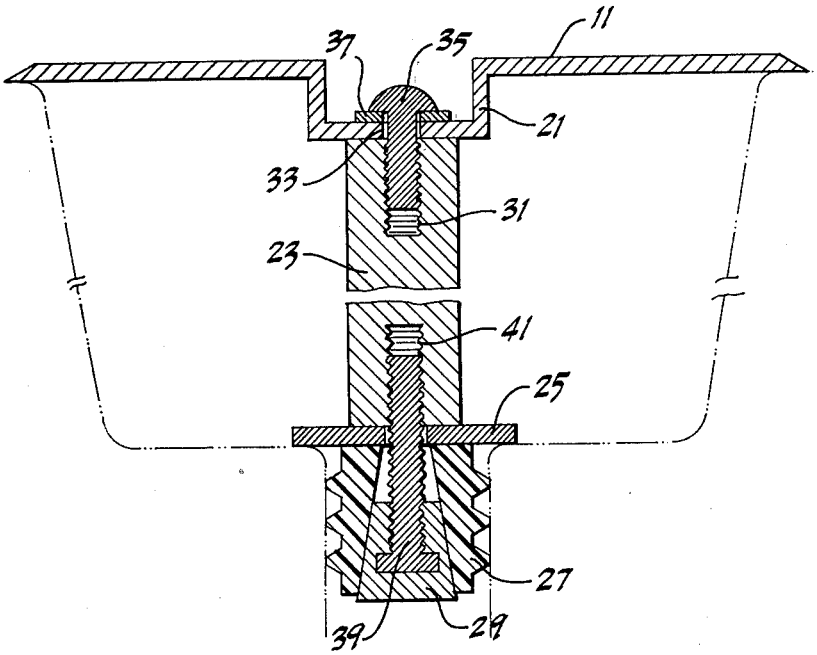
FIG. 3 shows a section of the embodiment illustrated in FIG. 2 taken on the lines 3—3 of FIG. 2 looking in the direction of the arrows.

FIG. 3 illustrates a cross-section of the apparatus of FIG. 2 taken on the line 3—3 of FIG. 2, looking in the direction of the arrows. Base member 11 has cylindrical recess 21 centrally located therein, which in turn has an opening 33 centrally located therein through which bolt 35 is inserted after having been passed through washer 37. Bolt 35 threadably engages threaded hole 31 in the end of elongated rod 23. The other end of elongated rod 23 has collar 25 mounted thereon which in turn has resilient plug 27 attached thereto by bolt 29 inserted in a central opening through resilient plug 27 and threadably engaging threaded opening 41 in the end of elongated rod 23.

Figure 4:
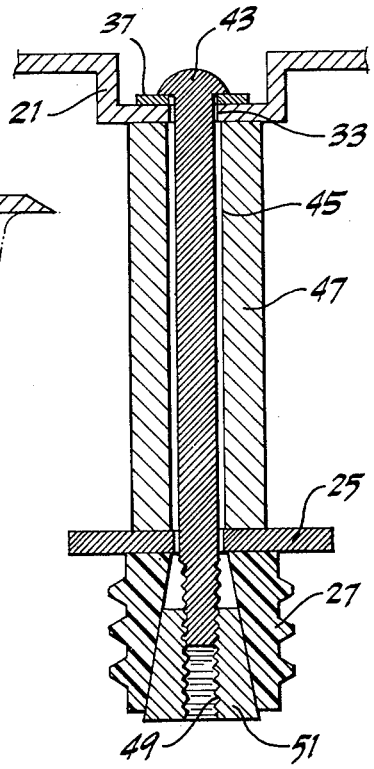
FIG. 4 illustrates an alternate construction for the drain seal of FIG. 3.

There is illustrated in FIG. 4 a cross-section of an alternate embodiment of the drain seal illustrated in FIG. 3 in which an elongated threaded bolt 43 passes through a washer 37 located within cylindrical recess 21, bolt 43 passing through opening 33 in recess 21 and continuing through a central opening 45 through the entire length of elongated rod 47 and through collar 25 and finally into threaded engagement with a frustoconical nut 51 having a threaded opening 49 centrally located therethrough. Nut 51 is located within a tapered central opening through resilient plug 27.

It should be noted that the protective cover and its components may be formed and molded from plastic or metallic materials or other similar or like materials and that resilient plug 27 may be made of any elastic material, such as rubber or soft plastic and the like.

Operation of the invention can best be described by referring to the figures. In FIG. 1, the flat rectangular base member 11 is placed over the sink opening such that projections 13 engage the innerside surfaces of the sink to align the edges of base member 11 with the peripheral lip of the sink. Tab projections 15 are added to further aid in a more precise alignment of the base member over the sink opening. So that base member 11 is strong enough to support the weight of personnel and equipment which may travel across the sink during installation, crossed ribs 17 are added.

In FIG. 2 curved projections 19 in the four corners of the base member serve as alignment projections in place of projections 13 and tabs 15 in FIG. 1. Further, elongated rod 23 with resilient plug 27 attached thereto centers the protective base member cover 11 over the sink opening when resilient plug 27 is inserted into the drain opening of the sink. Collar 25 is of larger diameter than resilient plug 27 so as to engage the peripheral edge of the drain opening of the sink to further provide mechanical support for elongated rod 23 attached to the central portion of base member 11. Therefore, extreme weights and pressures may be placed upon the protective cover base member 11 due to the mechanical support provided by the central rod supported in the drain opening of the sink.

The way in which the base member protective cover 11 is mounted in the sink is illustrated in FIG. 3 where the dashed lines indicate the inner surface of the sink and the drain opening. Resilient plug 27 is shown within the drain opening with collar 25, which could be an annular washer or the like, resting on the peripheral lip or edge of the drain opening of the sink to support elongated rod 23 and base member 11 attached thereto. Bolt 39 with frusto-conical head 29 within the tapered opening in resilient plug 27 is screwed into opening 41 of elongated rod 23, pulling head 29 into the tapered opening of plug 27 and expanding resilient plug 27 outward radially so as to tightly engage the surfaces of the drain opening of the sink. The outer surface of resilient plug 27 may have circular ribs or ridges thereon to further aid in sealing the drain opening. By reliably and dependably sealing the drain opening with resilient plug 27, pressurized leak tests may be performed on the plumbing connected to the drain.

Elongated rod 23 may be made in many lengths to adapt the protective cover assembly to many different sink depths. By unscrewing bolt 35 from threaded opening 31, elongated rod 23 can be removed from base member 11. Similarly, by removing bolt 39 and resilient plug 27, along with collar 25, elongated rod 23 may be replaced by another rod of different length to adapt the protective assembly to another sink dimension. It should also be apparent that the dimension of base member 11 may also be changed to match and meet the changes encountered in the opening dimensions of various sink sizes.

It should be apparent from FIG. 3 that bolt 39 must be adjusted to expand resilient plug 27 prior to being inserted into the drain opening of the sink. To provide an adjustable and tighter seal with the drain opening, FIG. 4 illustrates a bolt extending through base member 11 and through elongated rod 47 to engage frusto-conical nut 51. Therefore, after resilient plug 27 has been inserted into the drain opening of the sink, bolt 43 may be turned to further expand resilient plug 27 into a tight and binding seal within the drain opening of the sink. Therefore, this reliable and dependable seal allows pressurized tests to be utilized on the plumbing connected with the sink drain.

Once the protective cover assembly has been installed as described above to cover the sink opening and the peripheral lip of the sink, the sink is protected against damage and chipping at the edges from articles accidentally dropped and from inadvertently being filled with concrete or other floor construction materials while the adjacent floor is being constructed.

It now should be apparent that the present invention provides a weight supporting mechanical protective cover and drail seal assembly which may be employed in conjunction with floor sinks for protecting the sinks from damage during shipping and installation and to enable testing of the associated plumbing before constructing the floor therearound.

Although particular components, etc., have been discussed in connection with a specific embodiment of a protective sink cover in accordance with the teachings of the present invention, others may be utilized. Furthermore, it will be understood that although an exemplary embodiment of the present invention has been disclosed and discussed, other applications and mechanical structures and arrangements are possible and that the embodiments disclosed may be subjected to various changes, modifications and substitutions without necessarily departing from the spirit of the invention.

What is claimed is :

1. A protective cover for a sink comprising:

a base member having a surface thereof adapted to engage and mate with the peripheral lip of a sink opening whereby the peripheral lip and the opening of the sink are covered by said base member;

an elongated rod having one end thereof attached to and extending from said surface of said base member; and a resilient plug attached to the other end of said elongated rod, said resilient plug being adapted to engage and seal the drain opening of the sink and to mechanically support said base member attached thereto.

2. The protective cover described in claim 1 further including a collar attached to said elongated rod at the juncture of said rod and said resilient plug, said collar adapted to engage the peripheral edge of the drain opening of the sink to further mechanically support said elongated rod and said base member attached thereto.

3. The protective cover described in claim 1 wherein said elongated rod is attached to said base member by a threaded bolt, said base member having a hole therethrough through which said bolt is inserted and said elongated rod having a threaded hole in said one end to threadably engage said bolt.

4. The protective cover described in claim 2 wherein said resilient plug is attached to said other end of said elongated rod by a threaded bolt, said resilient plug having a hole therethrough through which said bolt is inserted and said elongated rod having a threaded hole in said other end to threadably engage said bolt, said resilient plug expanding radially about said bolt when said bolt is tightened to adjust said resilient plug to seal the drain openings of the sink.

5. The protective cover described in claim 1 wherein said elongated rod is attached to said base member and said resilient plug is attached to said rod by an elongated threaded bolt and a nut threadably engaged thereby, said base member having a hole therethrough and said elongated rod having a longitudinal shaft through the center thereof, said elongated threaded bolt being inserted through said hole in said base member and said longitudinal shaft in said rod, said resilient plug having a hole therethrough through which said elongated threaded bolt is inserted to threadably engage said nut, said resilient plug expanding radially about said threaded bolt as said nut is tightened thereon whereby an adjustable seal is provided for said drain opening.

* * * * *